United States Patent [19]

Günther

[11] Patent Number: 4,639,563

[45] Date of Patent: Jan. 27, 1987

[54] ACCELERATION AND DECELERATION SENSOR

[75] Inventor: Walter Günther, Nürnberg, Fed. Rep. of Germany

[73] Assignee: W. Günther GmbH, Nürnberg, Fed. Rep. of Germany

[21] Appl. No.: 663,185

[22] Filed: Oct. 22, 1984

[30] Foreign Application Priority Data

Oct. 21, 1983 [DE] Fed. Rep. of Germany ..... 3338287

[51] Int. Cl.[4] ..... H01H 35/14

[52] U.S. Cl. ..... 200/61.45 M; 200/61.53

[58] Field of Search ..... 200/61.45 M, 61.53, 200/82 E, 81.9 M, 84 C; 335/205, 206, 207; 340/669, 670, 52 H; 280/734, 737; 180/283, 284

[56] References Cited

U.S. PATENT DOCUMENTS 3,515,827 6/1970 Beeken ..... 200/82 E 3,611,220 10/1971 Hoffman ..... 335/207

3,673,527 6/1972 Wolf ..... 335/207

3,781,498 12/1973 Kamil et al. ..... 335/207

4,484,041 11/1984 Andres et al. ..... 200/61.45 M

FOREIGN PATENT DOCUMENTS 2644606 6/1978 Fed. Rep. of Germany .

3216321 9/1983 Fed. Rep. of Germany .

*Primary Examiner*—A. D. Pellinen

*Assistant Examiner*—Morris Ginsburg

*Attorney, Agent, or Firm*—Spencer & Frank

[57] ABSTRACT

An acceleration and deceleration sensor for use with safety devices in motor vehicles includes a reed switch and a movably mounted permanent magnet system which closes the switch during a collision. The permanent magnet system is provided by a pair of magnets having like poles which face each other, so that the magnets repel each other.

4 Claims, 2 Drawing Figures

ACCELERATION AND DECELERATION SENSOR

BACKGROUND OF THE INVENTION

The invention relates to an acceleration and deceleration sensor which can be used, in particular, for safety devices in motor vehicles. Such safety devices are comprised, for example, of a bag which can be inflated with compressed air and is disposed in the region of the steering wheel. In the case of a collision, this bag is inflated suddenly and prevents the driver from being thrown onto the steering wheel. The compressed air required to inflate the bag is carried in a compressed air tank which is normally sealed by means of a magnetic valve. In the case of a collision, the magnetic valve is opened, thus providing a path for the compressed air so that the air can flow from the reservoir tank into the above-mentioned bag. The magnetic valve may here be actuated, i.e. opened, by means of the sensor of the present invention. The sensor itself is comprised of an electrical switch as well as an inertial mass which actuates the switch and is displaceable in the direction of the acceleration and deceleration, respectively.

Acceleration and deceleration sensors of the above-mentioned type are described, for example, in German Laid-Open Patent Application No. 2,644,606 or in German Pat. No. 3,216,321. These prior art sensors include an electrical switch in the form of a reed switch which is disposed in the effective range of a permanent magnet system, with the permanent magnet system being an inertial mass which is displaceable in the direction of the acceleration or deceleration.

In the device of Laid-Open Patent Application No. 2,644,606, the permanent magnet system is an individual annular magnet which has a central opening that is placed onto a supporting pipe. The magnet is displaceable on the supporting pipe in the direction of the pipe, which direction coincides with the longitudinal axis of the ring magnet. In the interior of the supporting pipe, there is provided a reed switch which is arranged in such a manner that it is normally disposed outside the effective range of the permanent magnet and whose contact tongues are therefore normally open. If an acceleration or deceleration acts on this arrangement, the permanent magnet is displaced against the force of a spring so that it moves into the range of the reed switch. The field of the permanent magnet then magnetizes the contact tongues of the reed switch and closes them. When the acceleration or deceleration is terminated, the spring moves the permanent magnet back into its original position, thus opening the reed switch again.

In the arrangement disclosed in German Pat. No. 3,216,321, the permanent magnet system is a rod magnet which is mounted, due to its different spatial configuration, in a tubular housing. A reed switch is arranged in the wall of the tubular housing in such a manner that the reed switch is normally disposed outside the circle of action of the permanent magnet. If an acceleration or deceleration acts on the arrangement the rod-shaped permanent magnet is displaced, causing its field to move into the vicinity of the reed switch. The switching tongues of the reed switch are thus magnetized and closed. If the acceleration or deceleration is high enough, the permanent magnet will finally abut against a spring which is compressed by the force exerted on it in this way. After the acceleration or deceleration is terminated, the spring is relaxed again and pushes the rod magnet back until the rod magnet finally again takes up its original position if the recoil force of the spring was large enough.

It has been found that acceleration and deceleration sensors, in which the magnet system is comprised of an individual permanent magnet in combination with a mechanical spring, exhibit drawbacks. The springs require a certain minimum force for compression, thus limiting the effective range of the sensors. Additionally they considerably impede the switching or pulse times and they have the additional drawback that the particularly soft and easily compressible springs have a tendency to be damaged during the compression and, under certain circumstances, are deformed permanently.

SUMMARY OF THE INVENTION

It is the object of the invention to improve the known acceleration and deceleration sensors so that they operate with reproducible switching times and exhibit high response sensitivity. To accomplish this object, in the present invention the permanent magnet system is comprised of two permanent magnets which are magnetized in the direction of their longitudinal axes and face one another with their like poles. They are arranged one behind the other so as to be displaceable in the direction of their longitudinal axes. The use of two identically magnetized permanent magnets whose like poles face one another, brings about considerable advantages. On the one hand, the use of a mechanical resetting spring can be eliminated entirely so that the difficulties involved with the use of a spring are overcome. Moreover, the use of two magnets has the result that if the device is in the rest position, the switching tongues of the reed switch are also identically polarized and thus kept apart. The entire arrangement thus becomes insensitive to shocks and the switch as a whole is stabilized.

When one of the two magnets is displaced, at least one of the switching tongues is suddenly remagnetized, a process connected with a "snap effect" in the switch, i.e. a rapid response of the reed switch at the required moment of switching. Moreover, the mutually repelling fields make it possible to make the switch smaller in size, with reductions by about 50% compared to the prior art switches being possible.

The sensor and switch according to the invention may be constructed according to the above-stated principle in various embodiments. A preferred embodiment is characterized in that the reed switch is disposed in the interior of a supporting pipe with two ring magnets being disposed on the outer jacket of the supporting pipe so as to be displaceable in the direction of their longitudinal axes. The supporting pipe is here disposed in a housing which is closed on all sides, with the electrical switch leads being brought out of the housing and identically magnetized frontal faces of the ring magnets facing one another with a space therebetween. The frontal faces of the ring magnets facing away from one another rest against firm abutments in the housing.

The supporting pipe is preferably a piece of pipe made of a material which does not change even after longer periods of storage and, in particular, does not tend to adhere to the ring magnets disposed thereon. One advantageous material is glass; however, more easily processed materials can also be used, such as, for example, polytetrafluoroethylene.

Due to the fact that the supporting pipe together with the reed switch disposed therein and the displaceable ring magnet mounted on the supporting pipe itself are again accommodated in a housing which is closed on all sides, the entire unit is effectively protected against environmental influences, dust and the like. The arrangement may be such that the electrical switch leads, which are brought out of the sealed housing, come out of the housing on one side in the form of pins which are then simultaneously suitable as soldering pins for soldering onto printed circuit boards.

The movable parts disposed in the housing, i.e. the ring magnets, essentially determine the response sensitivity and the critical acceleration of the sensor. If the mass of the ring magnets should not be sufficient, it is possible to increase it and set it to the desired value by clamping a metal ring around them. The weighting metal for such a case would be ametal which itself isnot magnetizable, such as, for example, lead, brass, copper, aluminum or austenitic steel. However, magnetizable metals can also be used if these are arranged in the proper magnetic orientation, for example as pole pieces.

Not in every case must the magnet be a ring magnet. The principle disclosed here, which employs two permanent magnets, can also be realized with the use of rod magnets.

DESCRIPTION OF THE PREFERRED EMBODIMENTS

Figure 1:
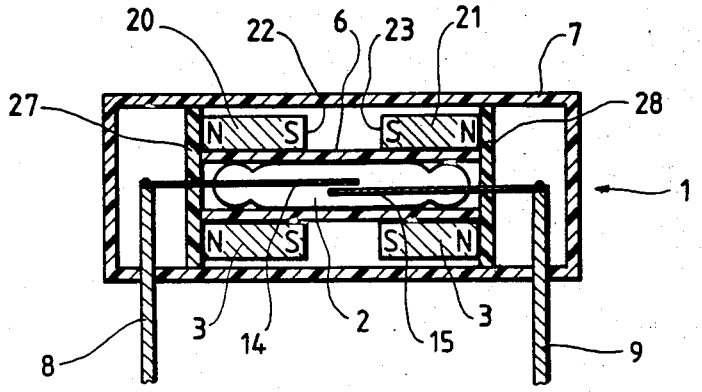
FIG. 1 is a sectional view of a sensor according to the present invention, and generally illustrates two ring magnets and a reed switch arranged in its center.

The acceleration and deceleration sensor shown in the respective drawing figures, hereinafter abbreviated as "sensor", is marked as a whole with the numeral 1 in FIG. 1. It essentially comprises a reed switch 2 and a permanent magnet system 3 which acts as the inertial mass. In the embodiment shown in FIG. 1, the permanent magnet system is composed of two annular permanent magnets 21 and 22, whose identically magnetized frontal faces 22 and 23 face one another. The magnetic poles are shown by the letters N and S. N indicates the "north pole" and S the "south pole" . The drawing shows that the south poles of the two ring magnets 20 and 21 face one another. However, this is without significance for the operation of the switch; both switches could also be rotated by 180° about their longitudinal axes so that their north poles would then face one another.

The two ring magnets 20 and 21 shown in FIG. 1 are mounted on a supporting pipe 6 and arranged in such a manner that they are mutally displaceable in the direction of their longitudinal axes. Reed switch 2 and its two contact strips 14 and 15 are disposed in the interior of the supporting pipe. The contact strips are electrically connected with switch terminals 8 and 9 which, in the illustrated embodiment, are brought out of the housing transversely to the longitudinal axis.

In the illustrated embodiment, supporting pipe 6 is mounted between end plates 27 and 28 which themselves are disposed in an outer housing 7. End plates 27 and 28 here serve as supports for supporting pipe 6 and also as abutments for the ring magnets 20 and 21 which are displaceably disposed on supporting pipe 6. Ring magnets 20 and 21 repel one another and consequently, in the normal case without acceleration, are in the position shown in the drawing.

The drawing shows that the two ring magnets 20 and 21, on the one hand, and the reed switch 2, on the other hand, are positioned with respect to one another in such a manner that contact strips 14 and 15 are both disposed in the range of influence of identically named magnetic fields. This means that the contact tongues are likewise identically magnetized at their facing ends and consequently move somewhat away from one another. The open position of the reed switch is thus stabilized.

If an acceleration or deceleration acts on the switch in the longitudinal direction, one of ring magnets 20 and 21 is moved toward the other against the repelling magnetic force. This means that the corresponding switching tongue 14 or 15 comes into the range of influence of the opposite magnetic pole, causing the tongues to suddenly, even violently, move toward one another and remain closed for the time during which the magnets occupy the new position.

Figure 2:
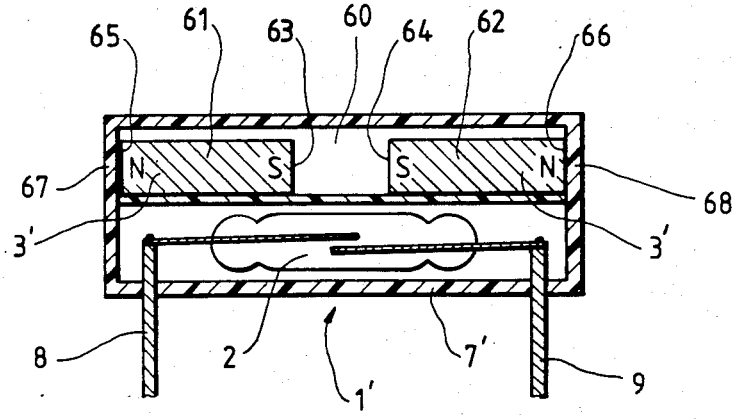
FIG. 2 is a sectional view of another embodiment of the sensor of the present invention, and generally illustrates two rod magnets and a reed switch arranged on its side.

FIG. 2 shows another embodiment of the invention in which the magnet system 3' of sensor 1' is comprised of two rod magnets 61 and 62 which are disposed in a cavity 60. The two rod magnets are magnetized in the same way as the above-mentioned ring magnets so that their two south poles face one another. The south poles are disposed at frontal faces 63 and 64. If no acceleration or deceleration acts on the arrangement, the two rod magnets repel one another and their frontal faces 65 and 66 which carry the north poles rest against the two outer walls 67 and 68 of housing 7'.

Reed switch 2 is disposed in a cavity parallel to cavity 60 and its two contact strips are again connected with terminal pins 8 and 9 which have been brought out of the housing and simultaneously serve as mounts for the reed switch.

I claim:

1. An acceleration and deceleration sensor, comprising:

a first abutment;

a second abutment spaced apart from said first abutment by a fixed distance;

a first permanent magnet slidably mounted between said first and second abutments;

a second permanent magnet slidably mounted between said first permanent magnet and said second abutment, said second permanent magnet being oriented to magnetically repel said first permanent magnet, so that mutual magnetic repulsion forces said first permanent magnet against said first abutment and forces said second permanent against said second abutment except when the sensor undergoes acceleration or deceleration; and a reed switch mounted adjacent said magnets, said reed switch being responsive to magnet position in order to sense an acceleration or deceleration which forces one magnet toward the other despite the repelling force.

2. An acceleration and deceleration sensor according to claim 1, wherein said magnets are ring magnets having central openings, and further comprising a supporting pipe which extends through said openings, said reed switch being disposed within said supporting pipe.

3. An acceleration and deceleration sensor according to claim 1, wherein said abutments comprise walls of a housing, wherein said magnets are rod magnets slidably disposed in said housing, and wherein said reed switch is disposed in said housing.

4. An acceleration and deceleration sensor according to claim 1, wherein said magnets have axes and are coaxially disposed.

* * * * *